United States Patent [19]

Baron

[11] Patent Number: 4,508,164

[45] Date of Patent: Apr. 2, 1985

[54] DASH POT BASKET FOR HEAT EXCHANGER TUBE CLEANING ELEMENT

[75] Inventor: Walter J. Baron, Milwaukee, Wis.

[73] Assignee: Water Services of America, Inc., Milwaukee, Wis.

[21] Appl. No.: 533,144

[22] Filed: Sep. 16, 1983

[51] Int. Cl.[3] ..... F28G 1/12

[52] U.S. Cl. ..... 165/95; 15/3.51

[58] Field of Search ..... 15/3.51, 104.06 R; 137/15, 242, 244; 165/95, 175

[56] References Cited

U.S. PATENT DOCUMENTS

| | | | |
|---|---|---|---|
| 3,319,710 | 5/1967 | Heeren et al. | 165/95 |
| 4,124,065 | 11/1978 | Leitner et al. | 165/95 |
| 4,397,349 | 8/1983 | Baron et al. | 15/3.51 X |

*Primary Examiner*—Stephen F. Husar

*Attorney, Agent, or Firm*—Andrus, Sceales, Starke & Sawall

[57] ABSTRACT

A heat exchanger has a plurality of fluid flow tubes secured adjacent their ends by tube sheets. Brushes are adapted to shuttle back and forth in the tubes and are adapted to be captured by baskets. The brushes comprise an elongated wire twist stem having fine wire bristles looped through the twist along the stem length. End caps are secured to the stem ends. The brush basket is provided with a dash pot at its outer end which not only serves as a brush stop but which also creates a hydraulic cushion to slowly decelerate the brush before it engages the stop.

4 Claims, 5 Drawing Figures

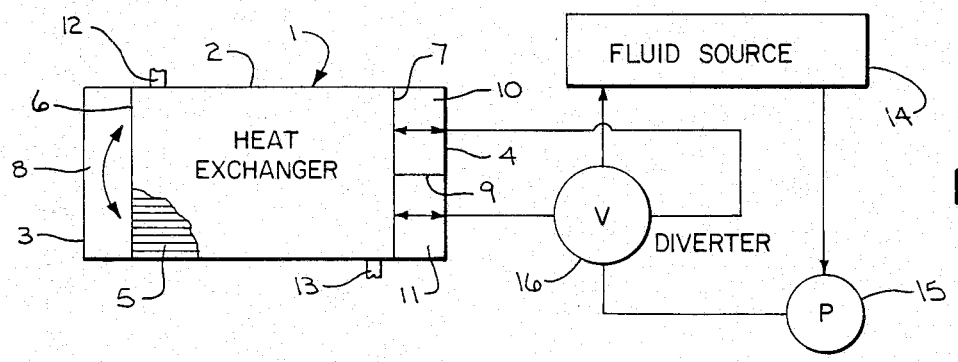
FIG.1
FIG.2
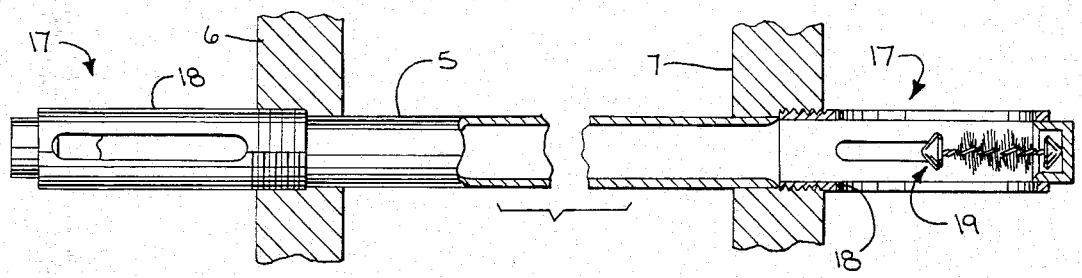
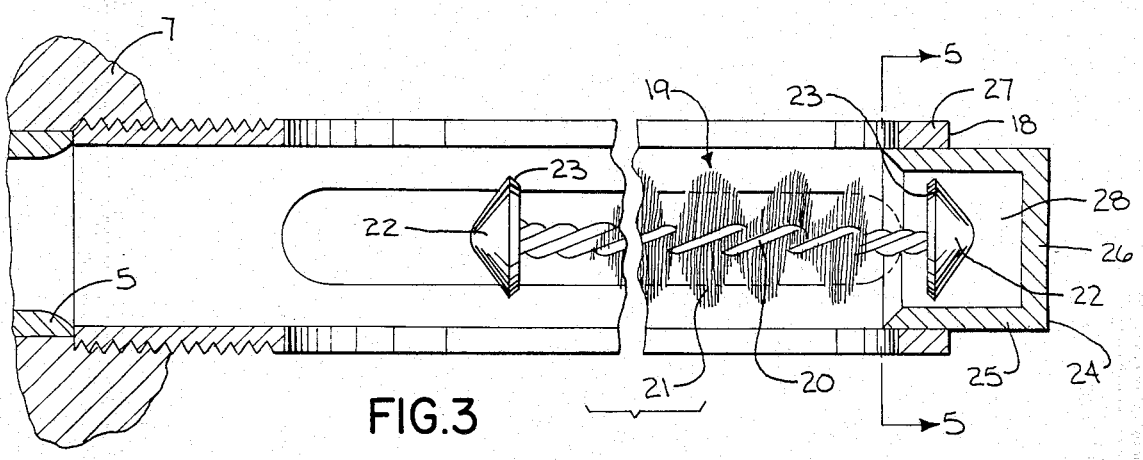
FIG.3
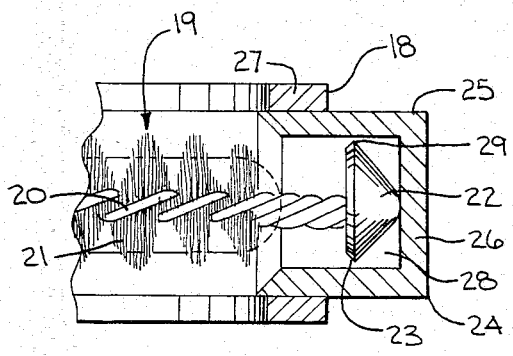
FIG.4
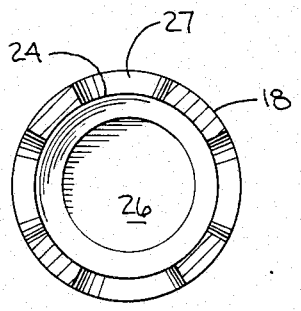
FIG.5

DASH POT BASKET FOR HEAT EXCHANGER TUBE CLEANING ELEMENT

U.S. PRIOR ART OF INTEREST

| U.S. Pat. No. | Inventor | Issued |
|---|---|---|
| 3,319,710 | Heeren et al. | May 16, 1967 |
| 4,124,065 | Leitner et al. | Nov. 7, 1978 |

BACKGROUND AND SUMMARY OF THE INVENTION

This invention relates to a dash pot basket for a heat exchanger tube cleaning element.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttleable cleaning elements such as brushes. Fluid flowing in one direction through the tubes keeps the cleaning elements captured within their respective basket chambers, while the fluid discharges outwardly through slot-like openings in the basket walls. Upon reversal of fluid flow, the cleaning elements are forced out of their baskets and through the tubes to the baskets at the opposite tube ends to thereby perform a tube cleaning action.

In many installations, as where heat exchanger temperatures and pressures are relatively low, tube cleaning shuttle brushes have often been made of plastic. However, in high temperature-high pressure applications, the brushes are preferably made of metal. The metal brushes have comprised an elongated wire twist stem having a fine bristle wire looped through the twist along the stem length. End caps are secured to the stem ends. The stem, bristles and end caps may be made of carbon steel, stainless steel or the like.

In many instances, the brush bristles have been held in position by friction within the twisted stem. However, it has been noted that the bristles have tended to loosen over a period of time, requiring brush replacement. Considering the many hundreds of tube cleaning brushes installed in a heat exchanger, brush replacement becomes costly and time consuming.

It has been discovered that one of the causes of brush bristle loosening is the shock which has occurred when the brush cap forcefully engages the stop member at the end of the basket. The shock force is in an axial direction and, over a period of time wherein many such shocks occur, it has been found that the brush twist wire tends to open, thereby permitting the bristles to come loose.

It is a task of the present invention to substantially reduce or eliminate the loosening of brush bristles form their anchor. It is a further task to prevent the twist wire stem from opening or distorting during the shuttling operation. It is yet another task to substantially reduce or eliminate the shock forces on the brush when it has reached the end of its travel in the basket.

In accordance with the various aspects of the invention, the brush capturing element or basket is provided with a dash pot at its outer end which not only serves as a brush stop but which also creates a hydraulic cushion to slowly decelerate the brush before it engages the stop. The dash pot provides a recess for receipt of a brush end cap. In the present embodiment, the I.D. of the recess is only slightly larger than the diameter of the brush end cap to thereby create a circumferential restricted flow passage for fluid to escape from the recess into the basket as the cap enters the recess. The I.D. of the recess may be slightly less than that of the heat exchanger tubes, while the I.D. of the basket walls may be somewhat greater.

BRIEF DESCRIPTION OF THE DRAWINGS

The accompanying drawings illustrate the best mode presently contemplated by the inventor for carrying out the invention.

In the drawings:

FIG. 1 is a schematic showing of a heat exchanger and fluid flow controls therefor;

FIG. 2 is a fragmentary longitudinal cross section through the heat exchanger and showing a tube cleaning brush captured in one of the baskets;

FIG. 3 is an enlarged longitudinal section of a basket and showing a brush entering the dash pot;

FIG. 4 is a fragmentary view showing the brush at the end of its stroke; and FIG. 5 is a section taken on line 5—5 of FIG. 3.

DESCRIPTION OF THE PREFERRED EMBODIMENT

The present invention is directed to tube-type heat exchangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, and as shown in FIG. 2, a plurality of cleaning assemblies 17 are disposed in chambers 8, 10 and 11 and include longitudinally extending elongated slotted baskets 18 which are mounted to tube sheets 6 and 7 so that they are in fluid communication with the interiors of tubes 5. Baskets 18 may be made of metal or any other suitable material.

Each pair of opposed baskets 18 is adapted to capture and hold a shuttling brush 19 which is propelled back and forth by fluid between the basket pair through the respective tube 5, depending upon the setting of valve 16. FIG.2 illustrates one brush 19 disposed in one end basket 18. Brush 19 generally comprises a twisted wire stem 20 holding an elongated spiral array of fine wire brush bristles 21 and conical end caps 22 having annular edges 23.

In accordance with the various aspects of the invention, baskets 18 are provided with dash pot means on their outer ends which serves as a stop for the brush 19 and which creates a hydraulic cushion to decelerate the brush before it engages the stop. As shown in FIG. 3, the dash pot 24 comprises an annular cup-shaped member having an annular side wall 25 and a closed bottom end wall 26. Dash pot 24 thus has a closed outer end and is secured within the outer end portion 27 of basket 18 and forms a recess 28 for receiving the end of a brush 19.

As shown, basket 18 is larger than heat exchanger tube 5 and dash pot 24. In addition, the I.D. of dash pot 24 is slightly less than that of tube 5. Furthermore, the diameter of the end cap edges 23 is slightly less than the I.D of dash pot 24 to provide a restricted annular passage 29 therebetween when the brush 19 enters recess 28.

As shown in FIG. 3, when brush 19 enters recess 28, fluid trapped in the recess will be forced to escape outwardly through passage 29, thus providing a hydraulic cushion which decelerates brush 19 until its velocity is negligible, at which time end cap 22 engages bottom wall 26 which functions as a stop for the brush. See FIG. 4.

The result of the hydraulic snubbing action is that axial shock forces on brush 19 and its stem 20 are substantially eliminated so that stem 20 does not open or otherwise distort. Bristles 21 will thereby remain in place much longer than previously without coming loose.

It is preferable that only end caps 22 enter the respective recesses 28 so that bristles 21 are free of undesirable engagement with dash pot walls 25.

While a basket separate from the tube end is shown in the drawings, a basket integral with the tube could be utilized without departing from the spirit of the invention.

Various modes of carrying out the invention are contemplated as being within the scope of the following claims particularly pointing and distinctly claiming the subject matter which is regarded as the invention.

I claim:

1. For use in a heat exchanger having a housing containing a plurality of fluid flow tubes arranged with exposed open ends, the combination comprising:

(a) an elongated basket adapted to capture a tube cleaning element which includes an elongated brush terminating in cap means and which is propelled through the tube by fluid, (b) the outer end portion of said basket having stop means thereon for engagement by a said cleaning element, (c) and means on said basket for decelerating said cleaning element before the latter reaches said stop means, (d) said cleaning element decelerating means comprising dash pot means disposed at the outer end of said basket for forming a hydraulic cushion for said cleaning element, (e) said dash pot means forming a recess for receiving said cleaning element and with said recess including said stop means, (f) said dash pot means and said cap means forming a restricted circumferential passage through which fluid escapes from said recess into said basket as said cap means approaches said stop means.

2. For use in a heat exchanger having a housing containing a plurality of fluid flow tubes arranged with exposed open ends, the combination comprising:

(a) an elongated basket adapted to capture a tube cleaning element which includes an elongated brush having bristles held by a twisted stem, (b) the outer end portion of said basket having stop means thereon for engagement by a said cleaning element, (c) and means on said basket for decelerating said cleaning element before the latter reaches said stop means, (d) said cleaning element decelerating means comprising dash pot means disposed at the outer end of said basket for forming a hydraulic cushion for said cleaning element, (e) said dash pot means forming a recess for receiving said cleaning element and with said recess including said stop means, (f) said dash pot means comprising means for reducing distortion of said stem when said brush engages said stop means.

3. For use in a heat exchanger having a housing containing a plurality of fluid flow tubes arranged with exposed open ends, the combination comprising:

(a) an elongated basket adapted to capture a tube cleaning element propelled through the tube by fluid, (b) the outer end portion of said basket having stop means thereon for engagement by a said cleaning element, (c) and means on said basket for decelerating said cleaning element before the latter reaches said stop means, (d) said cleaning element decelerating means comprising dash pot means disposed at the outer end of said basket for forming a hydraulic cushion for said cleaning element, (e) said dash pot means forming a recess for receiving said cleaning element and with said recess including said stop means, (f) said dash pot means and said cleaning element forming a restricted circumferential passage through which fluid escapes from said recess into said basket as said cleaning element approaches said stop means.

4. For use in a heat exchanger having a housing containing a plurality of fluid flow tubes arranged with exposed open ends, the combination comprising:

(a) an elongated basket adapted to capture a tube cleaning element propelled through the tube by fluid, (b) the outer end portion of said basket having stop means thereon for engagement by a said cleaning element, (c) and means on said basket for decelerating said cleaning element before the latter reaches said stop means, (d) said cleaning element decelerating means comprising a dash pot having a closed outer end and with said dash pot being disposed at the outer end of said basket for forming a hydraulic cushion for said cleaning element.

* * * * *